US008651353B2

(12) United States Patent
Koutouras et al.

(10) Patent No.: US 8,651,353 B2
(45) Date of Patent: Feb. 18, 2014

(54) GYM LOCKER ORGANIZER BACKPACK

(76) Inventors: Jennifer Lynn Koutouras, Kenilworth, IL (US); Kendra Christine Cunningham, Kenilworth, IL (US)

( * ) Notice: Subject to any disclaimer, the term of this patent is extended or adjusted under 35 U.S.C. 154(b) by 112 days.

(21) Appl. No.: 12/852,502

(22) Filed: Aug. 8, 2010

(65) Prior Publication Data

US 2012/0031943 A1 Feb. 9, 2012

(51) Int. Cl.
*A45F 3/04* (2006.01)

(52) U.S. Cl.
USPC ..... 224/653; 224/580; 224/627; 224/600; 383/38; 383/24

(58) Field of Classification Search
USPC ..... 224/653, 600, 627, 580, 584, 645, 257, 224/259; 383/38, 22
See application file for complete search history.

(56) References Cited

U.S. PATENT DOCUMENTS

| | | | | | |
|---|---|---|---|---|---|
| 1,684,232 | A * | 9/1928 | Levit | 383/38 |
| 4,164,968 | A * | 8/1979 | Esposito et al. | 224/607 |
| 4,753,329 | A * | 6/1988 | Choy | 190/111 |
| 4,773,515 | A * | 9/1988 | Kotkins, Jr. | 190/103 |
| 4,805,749 | A * | 2/1989 | Gerch | 190/111 |
| 4,859,084 | A * | 8/1989 | Kaumeyer | 383/39 |
| 4,984,662 | A * | 1/1991 | Jacober | 190/107 |
| 5,042,664 | A * | 8/1991 | Shyr et al. | 206/579 |
| 5,090,526 | A * | 2/1992 | Jacober | 190/107 |
| 5,544,792 | A * | 8/1996 | Arnwine | 224/153 |
| 5,743,447 | A * | 4/1998 | McDermott | 224/153 |
| 6,009,995 | A * | 1/2000 | Speck | 206/315.9 |
| 6,595,358 | B1 * | 7/2003 | Speck | 206/315.9 |
| 6,732,863 | B2 * | 5/2004 | Speck | 206/315.9 |
| 6,863,201 | B2 * | 3/2005 | Esqueda | 224/576 |
| 7,604,102 | B2 * | 10/2009 | Albritton | 190/107 |
| 2001/0017307 | A1 * | 8/2001 | Bentzen | 224/634 |
| 2002/0170935 | A1 * | 11/2002 | Annis | 224/653 |
| 2002/0179653 | A1 * | 12/2002 | Klamm | 224/153 |
| 2003/0197044 | A1 * | 10/2003 | Webb | 224/584 |
| 2003/0205601 | A1 * | 11/2003 | Kilduff | 224/627 |
| 2004/0022455 | A1 * | 2/2004 | Reason | 383/5 |
| 2004/0188482 | A1 * | 9/2004 | Wilson et al. | 224/576 |
| 2007/0119883 | A1 * | 5/2007 | Albritton | 224/153 |
| 2010/0051659 | A1 * | 3/2010 | Ferrari | 224/197 |
| 2010/0108731 | A1 * | 5/2010 | Rowe et al. | 224/654 |

* cited by examiner

*Primary Examiner* — Nathan J Newhouse
*Assistant Examiner* — Peter Helvey
(74) *Attorney, Agent, or Firm* — Cislo & Thomas, LLP

(57) ABSTRACT

A utility bag having shoulder straps which allows the bag to be used as a backpack to carry clothing, shoes, wet items, personal grooming items, etc. to a gym. At the gym the utility bag can be hung up on one or more of the locker hooks and, when the front panel of the utility bag is opened, all items in the utility bag can be easily accessed without removing the bag from the locker. The bag has a number of separate internally located compartments where each compartment can have a see thru mesh front panel which allows a user to see the contents of the compartment and allows air to circulate. The bag has pockets which are accessible from the outside of the bag which allow a user to quickly access a desired item such as a cell phone, wallet, etc. without opening the utility bag.

15 Claims, 4 Drawing Sheets

GYM LOCKER ORGANIZER BACKPACK

BACKGROUND OF THE INVENTION

1. Field of the Invention

The present invention relates generally to a utility bag which is used for carrying gym clothes and, more specifically to a utility bag that can be hung up in a gym locker and, while being hung up in the locker, all of the items in the bag can be accessed without removing the bag from the locker.

2. Description of Related Art

Utility bags for athletic purposes are known in the prior art. More specifically, by way of example, U.S. Pat. No. 5,042,664 to Shyr discloses a soft-sided utility bag having a hinged door-like end opening and a plurality of shelves which can be used to divide the bag enclosure into two or more compartments. The shelves are supported by flexible suspension structures which can be easily displaced out of the way when not in use. The shelves can be stored within the bag when the full, undivided volume of the bag is needed. The bag is collapsible for easy storage and/or transport.

U.S. Pat. No. 4,752,008 to Pratt discloses a utility bag which is generally rectangular in shape and sized to fit into an athletic locker or under the seat of an airplane. The utility bag has a pair of transversely positioned rectangular, rigid frame members longitudinally spaced apart within the interior of the bag; a fabric side panel having a width such that the forward and rearward edges of the side panel extend beyond the opposing outside edges of the frame members where the side panel covers the frame members on the outside surfaces to form the top, bottom and sidewalls of the utility bag; a rectangular fabric end panel attached at its edges to the edges of the side to form a closed rear end wall of the utility bag; an outwardly swinging, generally rectangular fabric door attached in hinge-like fashion along one elongate edge thereof to a forward sidewall edge of a side panel of the utility bag; and zipper closure means attached to the forward edge of the side panel and the other three side edges of the rectangular fabric door for releasably securing the fabric door in a closed position to the otherwise open, front end of the utility bag.

U.S. Pat. No. 1,137,579 to Cohn discloses a valise with an open side carrying pockets on the inside and in its body portion with means to support a plurality of trays which are accessible from the top or at one side of the valise.

U.S. Pat. No. 2,018,809 to Rodgers discloses a convertible hand bag having two compartments where the bag can be converted into various shapes.

U.S. Pat. No. 2,517,757 to Adlerstein discloses a knapsack having a tubular frame for supporting shelves which are attached to the rear wall of the knapsack by sewing or with snaps.

U.S. Pat. No. 3,963,102 to Carp discloses a carry-on luggage bag of flexible material with top closure flaps interconnected with a zipper. An elongated U shaped liner is mounted on and spans the side walls of the bag, with the bottom wall of the liner spaced from the housing bottom wall to define an auxiliary storage chamber. One side wall is cut away near the auxiliary chamber to provide a side flap with a zipper. An upright divider is mounted upon the liner bottom wall to provide a first storage chamber for receiving a tote bag which can receive an umbrella.

U.S. Pat. No. 4,212,377 to Weinreb discloses a convertible utility bag which has a divider panel spaced from and parallel to the bottom of the bag to provide, in a first position, two compartments of unequal size and to provide, when swung against the back of the bag, a larger compartment.

U.S. Pat. No. 4,773,515 to Kotkins discloses a multi-compartment, expansible luggage bag having a main storage compartment with one or more expansible joints to increase the size of the main storage compartment. In conjunction with the main storage compartment, there is also provided a separable end storage compartment having an inner flexible membrane that can be extended inwardly beyond each of the expansion joints to maximize the volume of the end storage compartment when the expansion joints are open.

U.S. Pat. No. 4,805,748 to Gerch discloses a sports duffle bag having a top opening tubular body and a sidewall open top pocket sized to snugly receive the head of a tennis racket. An opening at a top corner of the pocket permits the racket handle to project from the pocket. An expansion panel is secured in the mouth of the pocket and has two flaps connected by a slide fastener so that in the open position the flaps hang in the pocket alongside the head of the racket and in the closed position the flaps are pulled above the pocket and closed over a racket head extending above the pocket to increase the height of the pocket for accommodating oversized rackets.

U.S. Pat. No. 4,805,749 to Gerch discloses an improved tube shape duffel-type travel or sports bag having an oblong softsided central compartment with access through the top, and a pair of matching smaller compartments, one each on the opposing ends of the oblong central compartment. The opposing compartments have circumferential zippered openings therearound. One of the end compartments includes a plurality of pockets/dividers and the opposing smaller compartment on the opposite end of the bag has an expansible wall. The expansible wall includes a collapsible pocket of waterproof material, which is capable of extending into the main compartment and expanding therein as desired, preferably for positioning worn clothing or accessories therein.

SUMMARY OF THE INVENTION

In an exemplary embodiment of the present invention, there is disclosed a utility bag having a substantially rectangular shape which is adapted to fit within a gym locker comprising:

- a substantially rectangular top panel of fabric having a front end, a rear end and two side ends wherein the narrow dimension of the rectangular panel is the front and rear ends of the top panel and the wide dimension of the rectangular panel is the sides of the top panel;
- first and second side panels of substantially rectangular fabric having top ends, bottom ends and side ends wherein the top ends of the narrow dimension of the side panels are attached to the wide dimension of the first and second side ends of the rectangular top panel;
- a substantially rectangular rear panel of fabric having a top end, a bottom end and side ends wherein the top end of the narrow dimension of the rectangular rear panel is attached to the narrow rear end of the top panel, and the side ends of the rear panel are attached to side ends of the first and second side panels;
- a rectangular substantially rigid bottom panel having a front end, a rear end and two side ends wherein the narrow dimension is the front and rear ends of the bottom panel and the wide dimension is the sides of the bottom panel, and wherein the rear end of the bottom panel is attached to the bottom end of the rear panel and the side ends of the bottom panel are attached to the bottom ends of the first and second side panels;
- a substantially rectangular front panel of fabric having a top end, a bottom end and two side ends wherein the bottom end of the narrow dimension of the rectangular panel is swingably attached to the front end of the bottom panel and the two side ends of the front panel are removably connected to the side ends of the first and second side panels and the top end of the front panel is removably connected to the front end of the top panel;

wherein the interior of the utility bag has at least three compartments each being accessible only when the top end and two side ends of the front panel is not attached to the top panel and the side panels; and shoulder straps attached to the top and bottom ends of the first side panel for carrying the utility bag as a backpack.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

There is disclosed a utility bag which can be carried on a person's shoulders as a backpack and has separate compartments for carrying clothes, shoes, wet items, personal grooming items, a gym card, a lock, a cell phone, etc. which are normally used when working out at a gym. The backpack can be carried on a person's shoulders as he/she goes to the gym and, upon arriving at the gym, removes the backpack from his/her shoulders and hangs it on a bar or hook in a gym locker. The backpack has a rectangular shape where the width of the backpack is less than the width of the gym locker and the depth of the backpack is less than the depth of the gym locker. Thus, the backpack has a size which fits easily into a gym locker and can be hung on a bar or hook in the locker where the front of the utility bag faces the front of the locker and the items in the backpack can be accessed without removing the bag from the locker.

The utility bag has separate compartments and various pockets for items such as shoes, sneakers, toiletries, gym clothing, etc. When a person enters a gym and places the bag into a gym locker, he/she opens the front of the bag and, without removing the bag from the locker, removes various items from the bag for use while in the gym. At the same time, he/she can place street items into the hanging bag for temporary storage. The compartments can be opened and closed with their own snap or slide fastener, and the various compartments have a mesh covering for viewing the contents of the compartments and/or for breathing. In addition to the compartments which are located within the utility bag, one or more pockets of different depths are provided which are accessible from the outside of the bag to allow the user to quickly and easily reach a gym card, a cell phone, a wallet or other items without opening the bag. In addition to the pockets which are accessible from the outside of the bag, at least one small pocket is located on at least one of the shoulder straps of the bag for receiving a small item such as a car or house key, a cell phone, etc.

Figure 1:
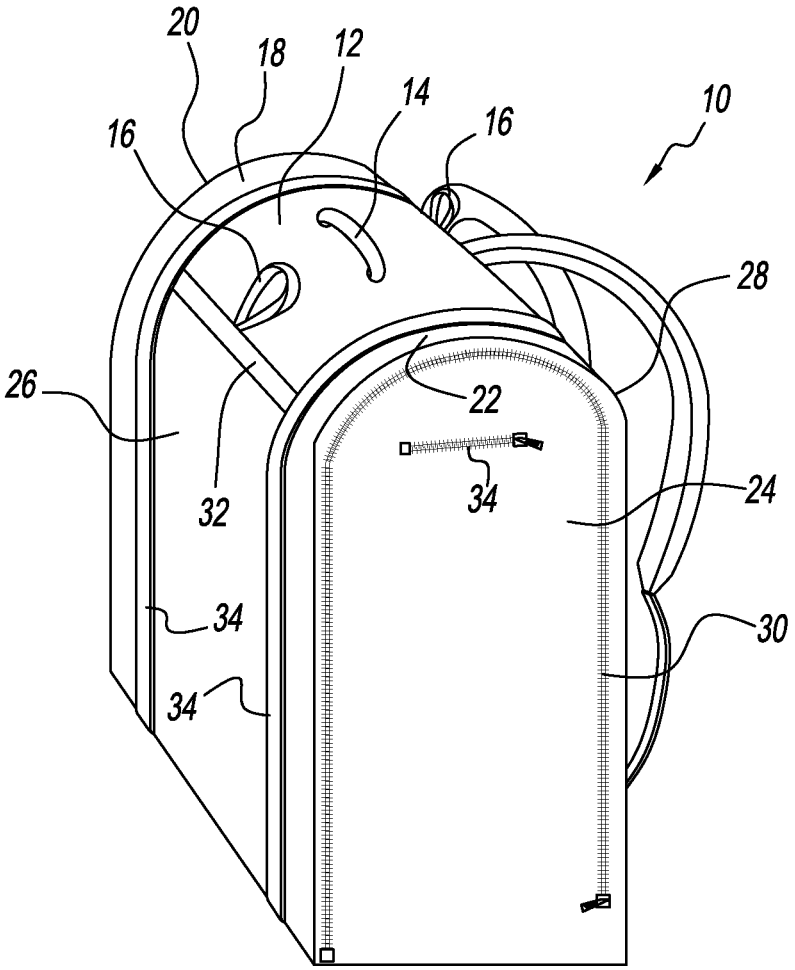
FIG. 1 is a perspective view showing the front of a gym locker organizer backpack in accordance with the principles of the invention.

Referring to FIG. 1, there is shown a perspective view of the front of a utility bag 10 which is used as a gym locker organizer backpack in accordance with the principles of the invention. The utility bag has a curved top panel 12, a padded carrying handle 14 centrally located at the top of panel 12, and a loop 16 located at each side of the top panel 12. The top panel has a rectangular shape where a back end 18 is permanently attached to a back panel 20 of the utility bag and the front end 22 which is removably attached to a front panel 24 of the utility bag. One side edge of the top panel 12 is permanently attached to a side panel 26 and the other side edge of the top panel is permanently attached to another side panel 28.

The bottom end of back panel 20, side panel 26, side panel 28 and front panel 24 are permanently attached to a bottom panel of the utility bag. A slide closure such as a zipper 30 having two pulls for opening and closing the zipper removably attaches the two side panels and the top end of the front panel 24 to the side panels 26, 28 and the top panel 12. When the front panel 24 is not attached with the closed zipper to the side and top panels, the bottom end of the front panel folds down along its bottom edge and the front panel falls down below the bottom of the bag. Reinforcing straps 32 are provided between the curved top panel and the side panels 26, 28, and provide additional attachment support to the connection of loops 16 to the bag. Two reinforcing straps 34 having a width of about one and one-half inches extend around the sides and top of the bag. Straps 34 are located about one and one-half inches from the front and back edges of the side and top panels and can have a decorative design in a color that blends with the color of side and top panels. For example, if the utility bag is black, the straps can be black and the design on the straps 32 can be in silver. A pocket which is accessible from the outside of the bag and can be closed with a zipper, snap, Velcro, hook, etc., 34 is located in the front panel.

Figure 2:
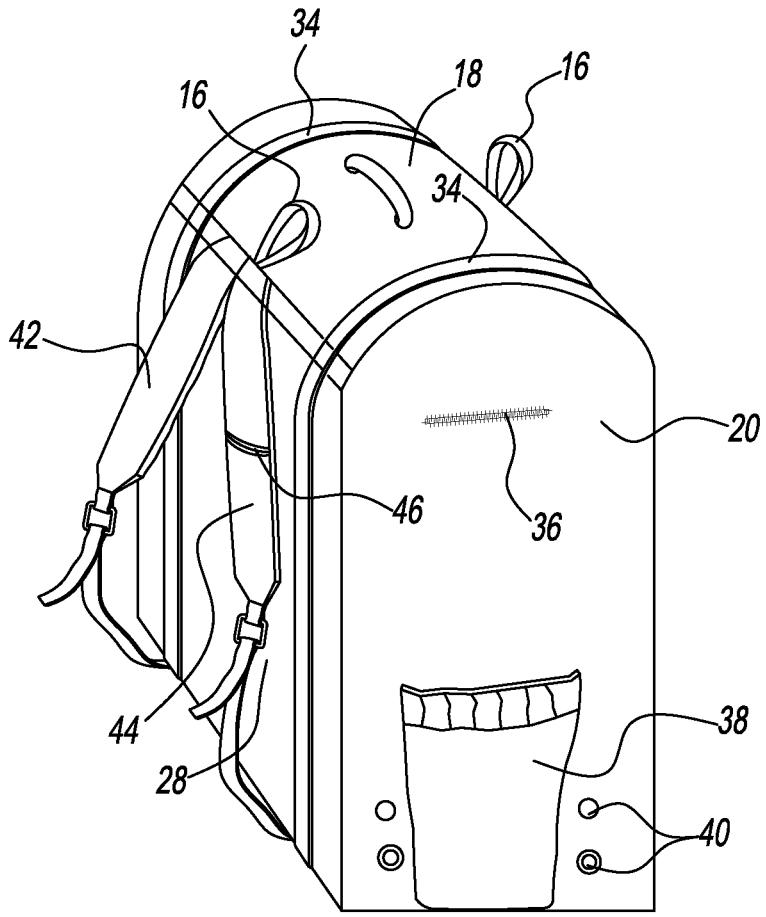
FIG. 2 is a perspective view showing the rear of the gym locker organizer backpack of FIG. 1 in accordance with the principles of the invention.

Referring to FIG. 2, there is shown a perspective view of the rear of the gym locker organizer backpack of FIG. 1. The rear panel 20 has a pocket 36 located near the top of the bag and which is accessible from the outside of the rear panel. Pocket 36 can be closed with a zipper, hook, Velcro, snaps, etc. An externally located pocket 38 positioned near the bottom of the bag has an elastic cuff located at its top edge for closing the top end of the pocket. A user can access an article which is located in pocket 38 by simply inserting his/her hand past the elastic cuff and into the pocket. Small circular vent openings 40 located on each side of pocket 38 allow air to circulate within the bag. The vent openings can include circular grommets having a metal screen center.

To allow the utility bag to be used as a backpack, shoulder straps 42, 44 are provided along side 28 of the utility bag. The top portions of the straps are padded for comfort and each strap has a buckle for adjusting the length of the shoulder straps. Located on either one or on each of the shoulder straps is a small pocket 46 which has an elastic cuff top which keeps the top of the pocket closed. This pocket can be used to hold a user's cell phone, keys for his/her car and/or house or any other small item.

Figure 3:
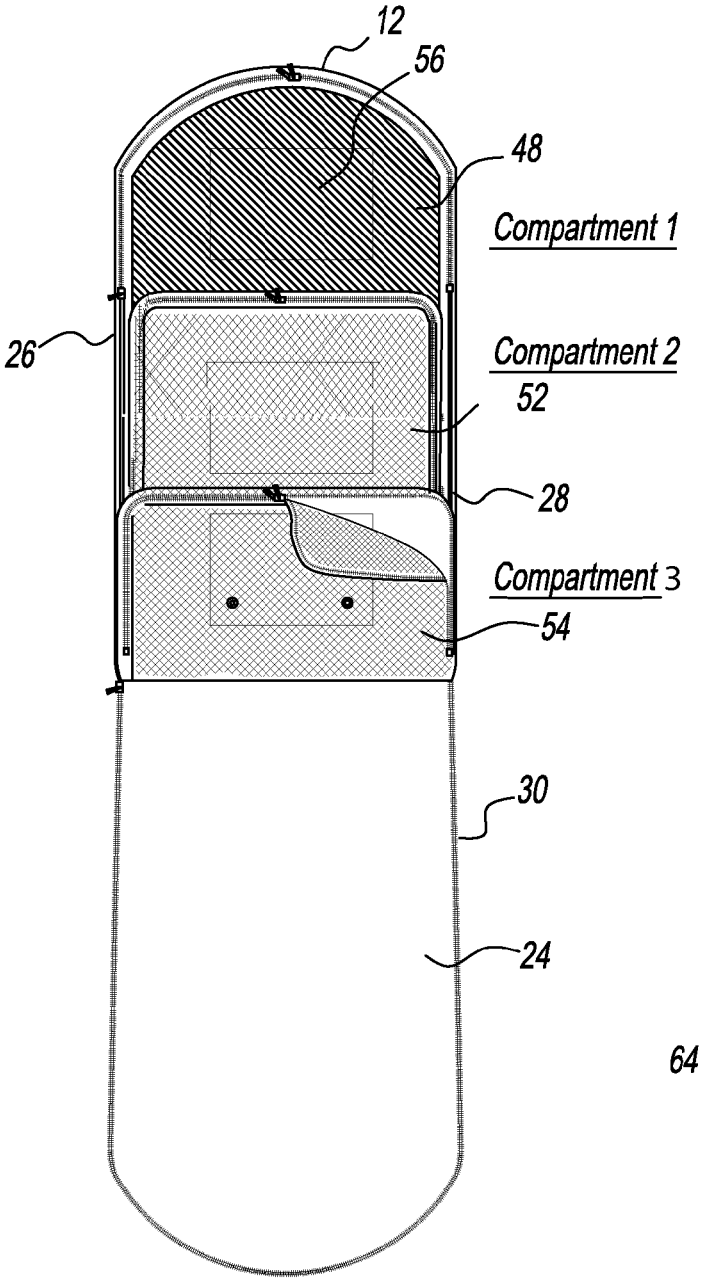
FIG. 3 is a view looking into the open front of the gym locker organizer backpack of FIG. 1 showing the various compartments where the front of the knapsack is hanging down in accordance with the principles of the invention.

Referring to FIG. 3, there is a view looking into the open front of the gym locker organizer backpack of FIG. 1 showing three compartments when the front panel of the backpack is not attached to the side and top panels and folds down along its bottom end to hang below the bag. The interior of the gym locker organizer backpack shown has three compartments 48, 52 and 54. The floor or base of each compartment is composed of a corrugated plastic material located in a fabric pocket which is permanently fixed in position and is attached to the bag with snaps, Velcro, etc. The corrugated material provides a relatively stiff non sagging floor for each compartment which helps to provide a bag that is made of fabric to maintain its width dimension, even when each compartment is only partially filled. The front panel of the top compartment 48 has a see thru mesh fabric 56 made of nylon which can be positioned over and close the front of the compartment with a zipper having a double pull where the zipper extends along the top and two sides of the pocket. When the two pulls are used to open the zipper on the front of the top compartment, the see thru mesh fabric folds along its bottom edge and hangs down below the floor of the compartment to allow a user to either retrieve an item from, or insert an item into the compartment.

Compartment 48 can be used for dry clothes or other items. Compartment 52, which is located immediately below, can be used for a cosmetic case for toiletries and/or for personal items. A pull out bag made of water resistant material such as nylon and having a fold over or zippered leak resistant closure is provided (not shown) for holding damp or wet clothes which may be placed in the middle compartment. The water resistant pull out bag is provided to prevent water from wet clothing from dripping onto articles in lower compartment 54, which can be used for holding sneakers or shoes.

Figure 5:
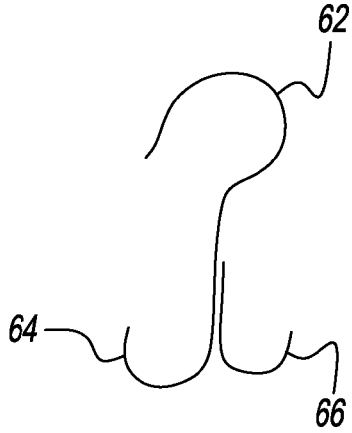
FIG. 5 is a side view of a hook which can be used to hang the gym locker organizer backpack of FIG. 1 from a gym locker hook.
Figure 4:
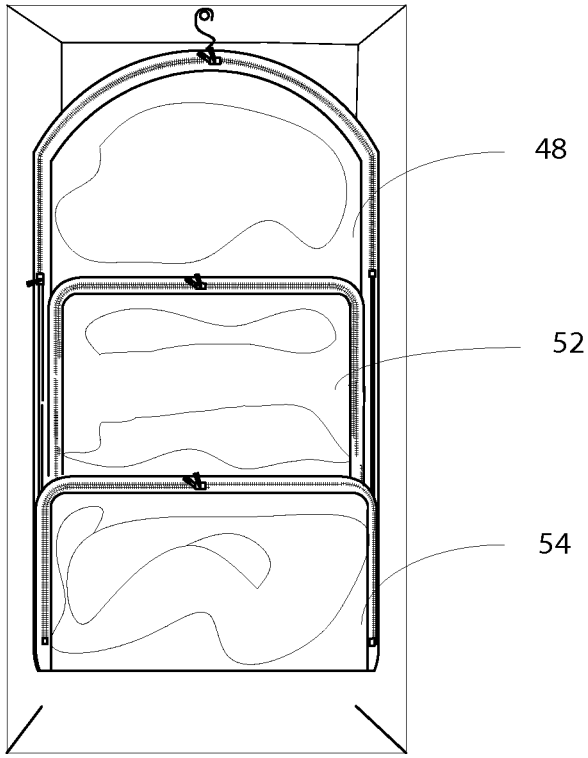
FIG. 4 is a view of the gym locker organizer backpack of FIG. 1 in use hanging in a gym locker with various user items and articles of gym attire neatly and conveniently compartmentalized in different compartments in accordance with the principles of the invention.

FIG. 4 is a view of the gym locker organizer backpack of FIG. 1 in use hanging in a gym locker with various user items and articles of gym attire neatly and conveniently compartmentalized in different compartments in accordance with the principles of the invention. In use, a person with the gym locker organizer backpack here disclosed goes to a gym and opens the door of a gym locker. Gym lockers are normally 9 inches, 12 inches or 15 inches wide where most lockers are 12 inches wide. Bag 10 is substantially eight and one half inches wide and, therefore, can be placed into any standard gym locker. A gym locker will normally have a hook on each side wall which can be used for hanging the bag. The bag can be inserted into and hung up in the locker by placing the clothes loops 16, see FIG. 1, located at the top of the bag onto the hooks on the side walls of the gym locker. If, however, the locker has a hook attached to the top of the locker, the gym locker organizer backpack can be hung from the handy organizer having hooks shown in FIG. 5 provided with the gym locker organizer backpack. Hook 60 shown in FIG. 5 has a top hook 62 for placement on a hook which is located at the top of a gym locker and side hooks 64, 66 are for holding the loops 16 on the utility bag.

In addition to the hook of FIG. 5, to provide hanging versility and flexibility, an extension strap, which can have a length of about thirty five inches, more or less with a snap, hook, Velcro, etc, at each end (not shown) is also provided with the gym locker organizer backpack.

The fabric from which the various panels are made is preferably a fabric made of Nylon which may have a water proof inner surface.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A utility bag having a substantially rectangular shape which is adapted to fit within a gym locker comprising, a substantially rectangular top panel of fabric having a front end, a rear end and two side ends wherein the narrow dimension of the rectangular top panel is the front and rear ends of the top panel and the wide dimension of the rectangular panel is the side ends of the top panel;

first and second side panels of substantially rectangular fabric having top ends, bottom ends and side ends wherein the top ends of the narrow dimension of the side panels are attached to the wide dimension of the first and second side ends of the rectangular top panel, respectively;

a substantially rectangular rear panel of fabric having a top end, a bottom end and side ends wherein the top end of the narrow dimension of the rectangular rear panel is attached to the narrow rear end of the top panel, and the side ends of the rear panel are attached to side ends of the first and second side panels, respectively;

a rectangular substantially rigid bottom panel having a front end, a rear end and two side ends wherein the narrow dimension is the front and rear ends of the bottom panel and the wide dimension is the side ends of the bottom panel, and wherein the rear end of the bottom panel is attached to the bottom end of the rear panel and the side ends of the bottom panel are attached to the bottom ends of the first and second side panels, respectively;

a substantially rectangular front panel of fabric having a top end, a bottom end and two side ends wherein the bottom end of the narrow dimension of the rectangular front panel is swingably attached to the front end of the bottom panel, and the two side ends of the front panel are removably connected to the side ends of the first and second side panels, respectively, and the top end of the front panel is removably connected to the front end of the top panel;

wherein the interior of the utility bag has at least three compartments each having an opening that is accessible only when the top end and two side ends of the front panel is not attached to the top panel and the side panels, wherein the opening of at least one of the three compartments is substantially and reversibly closed by a see through covering; and shoulder straps attached to the top and bottom ends of the first side panel for carrying the utility bag as a backpack.

2. The utility bag of claim 1 wherein the two side ends and the top end of the front panel are removably connected to the side ends of the first and second side panels and the top end of the front panel with a slidable connector.

3. The utility bag of claim 2 wherein said slidable connector is a zipper.

4. The utility bag of claim 3 further comprising a carry handle attached to the top panel of fabric.

5. The utility bag of claim 4 wherein said three compartments are linearly arranged in a vertical manner.

6. The utility bag of claim 5 wherein the see through covering is comprised of mesh fabric.

7. The utility bag of claim 6 wherein each side end of the top panel has attached to it a loop of fabric, each loop comprising a length of fabric with two ends, for hanging the utility bag on at least one hook in a gym locker, wherein the two ends of each loop of fabric are attached to utility bag immediately adjacent to each other.

8. The utility bag of claim 7 wherein a pocket is located in at least one of the shoulder straps.

9. The utility bag of claim 8 wherein each compartment has a floor of generally rigid foam.

10. The utility bag of claim 9 wherein said generally rigid foam is located in a fabric envelope.

11. The utility bag of claim 10 wherein said panels are made of nylon.

12. The utility bag of claim 11 wherein the front panel has a pocket that is accessible from the outside of the bag.

13. The utility bag of claim 12 wherein said pocket has a slidable closure.

14. The utility bag of claim 13 wherein said rear panel has two pockets which are accessible from the outside of the bag.

15. The utility bag of claim 14 wherein one pocket has a slidable closure and the other pocket has an elastic closure.

* * * * *